US007105446B2

(12) United States Patent
Chuang et al.

(10) Patent No.: US 7,105,446 B2
(45) Date of Patent: Sep. 12, 2006

(54) APPARATUS FOR PRE-CONDITIONING CMP POLISHING PAD

(75) Inventors: Chia-Che Chuang, Tainan (TW); Wen-Chih Chiou, Miaoli (TW); Hsin-Hsien Lu, Hsin Chu (TW); Liang-Guang Chen, Yilan (TW)

(73) Assignee: Taiwan Semiconductor Manufacturing Co., Ltd., Hsin-Chu (TW)

( * ) Notice: Subject to any disclaimer, the term of this patent is extended or adjusted under 35 U.S.C. 154(b) by 87 days.

(21) Appl. No.: 10/656,585

(22) Filed: Sep. 4, 2003

(65) Prior Publication Data

US 2005/0051266 A1 Mar. 10, 2005

(51) Int. Cl.
*B24B 7/00* (2006.01)

(52) U.S. Cl. ..... 438/689; 451/72

(58) Field of Classification Search ..... 451/72
See application file for complete search history.

(56) References Cited

U.S. PATENT DOCUMENTS

| | | | | |
|---|---|---|---|---|
| 6,273,798 | B1 * | 8/2001 | Berman | 451/72 |
| 2002/0098779 | A1 * | 7/2002 | Tsai et al. | 451/36 |
| 2004/0259477 | A1 * | 12/2004 | Anderson | 451/21 |

* cited by examiner

*Primary Examiner*—Thanh Nguyen
(74) *Attorney, Agent, or Firm*—Tung & Associates

(57) ABSTRACT

An apparatus and method suitable for the pre-conditioning of a polishing pad on a CMP apparatus prior to the polishing of production wafers on the apparatus. The apparatus includes a pre-conditioning arm on which is mounted an ingot of suitable material. In use, the ingot is pressed against the polishing surface of the rotating polishing pad for a selected period of time to increase the temperature of the polishing surface by friction. The pre-conditioned polishing pad facilitates uniform polishing rates of production semiconductor wafers subsequently polished on the apparatus.

7 Claims, 3 Drawing Sheets

APPARATUS FOR PRE-CONDITIONING CMP POLISHING PAD

FIELD OF THE INVENTION

The present invention relates to apparatus and methods for the conditioning of polishing pads on chemical mechanical polishers for semiconductor wafers. More particularly, the present invention relates to a new and improved apparatus and method which is suitable for pre-conditioning polishing pads in chemical mechanical polishers without the need for dummy wafers.

BACKGROUND OF THE INVENTION

Apparatus for polishing thin, flat semiconductor wafers are well-known in the art. Such apparatus normally includes a polishing head which carries a membrane for engaging and forcing a semiconductor wafer against a wetted polishing surface, such as a polishing pad. Either the pad or the polishing head is rotated and oscillates the wafer over the polishing surface. The polishing head is forced downwardly onto the polishing surface by a pressurized air system or similar arrangement. The downward force pressing the polishing head against the polishing surface can be adjusted as desired. The polishing head is typically mounted on an elongated pivoting carrier arm, which can move the pressure head between several operative positions. In one operative position, the carrier arm positions a wafer mounted on the pressure head in contact with the polishing pad. In order to remove the wafer from contact with the polishing surface, the carrier arm is first pivoted upwardly to lift the pressure head and wafer from the polishing surface. The carrier arm is then pivoted laterally to move the pressure head and wafer carried by the pressure head to an auxiliary wafer processing station. The auxiliary processing station may include, for example, a station for cleaning the wafer and/or polishing head, a wafer unload station, or a wafer load station.

More recently, chemical-mechanical polishing (CMP) apparatus has been employed in combination with a pneumatically actuated polishing head. CMP apparatus is used primarily for polishing the front face or device side of a semiconductor wafer during the fabrication of semiconductor devices on the wafer. A wafer is "planarized" or smoothed one or more times during a fabrication process in order for the top surface of the wafer to be as flat as possible. A wafer is polished by being placed on a carrier and pressed face down onto a polishing pad covered with a slurry of colloidal silica or alumina in deionized water.

A schematic of a typical CMP apparatus is shown in FIGS. 1A and 1B. The apparatus 20 for chemical mechanical polishing consists of a rotating wafer holder 14 that holds the wafer 10, the appropriate slurry 24, and a polishing pad 12 which is normally mounted to a rotating table 26 by adhesive means. The polishing pad 12 is applied to the wafer surface 22 at a specific pressure. The chemical mechanical polishing method can be used to provide a planar surface on dielectric layers, on deep and shallow trenches that are filled with polysilicon or oxide, and on various metal films.

CMP polishing results from a combination of chemical and mechanical effects. A possible mechanism for the CMP process involves the formation of a chemically altered layer at the surface of the material being polished. The layer is mechanically removed from the underlying bulk material. An altered layer is then regrown on the surface while the process is repeated again. For instance, in metal polishing, a metal oxide may be formed and removed separately.

A polishing pad is typically constructed in two layers overlying a platen with the resilient layer as the outer layer of the pad. The layers are typically made of polyurethane and may include a filler for controlling the dimensional stability of the layers. The polishing pad is usually several times the diameter of a wafer and the wafer is kept off-center on the pad to prevent polishing a non-planar surface onto the wafer. The wafer is also rotated to prevent polishing a taper into the wafer. Although the axis of rotation of the wafer and the axis of rotation of the pad are not collinear, the axes must be parallel.

In a CMP head, large variations in the removal rate, or polishing rate, across the whole wafer area are frequently observed. A thickness variation across the wafer is therefore produced as a major cause for wafer non-uniformity. In the improved CMP head design, even though a pneumatic system for forcing the wafer surface onto a polishing pad is used, the system cannot selectively apply different pressures at different locations on the surface of the wafer. This effect is shown in FIG. 1C, i.e. in a profilometer trace obtained on an 8-inch wafer. The thickness difference between the highest point and the lowest point on the wafer is almost 2,000 angstroms, resulting in a standard deviation of 472 angstroms, or 6.26%. The curve shown in FIG. 1C is plotted with the removal rates in the vertical axis and the distance from the center of the wafer in the horizontal axis. It is seen that the removal rates obtained at the edge portions of the wafer are substantially higher than the removal rates at or near the center of the wafer. The thickness uniformity on the resulting wafer after the CMP process is poor.

The polishing pad 12 is a consumable item used in a semiconductor wafer fabrication process. Under normal wafer fabrication conditions, the polishing pad is replaced after about 12 hours of usage. Polishing pads may be hard, incompressible pads or soft pads. For oxide polishing, hard and stiffer pads are generally used to achieve planarity. Softer pads are generally used in other polishing processes to achieve improved uniformity and smooth surfaces. The hard pads and the soft pads may also be combined in an arrangement of stacked pads for customized applications.

A problem frequently encountered in the use of polishing pads in oxide planarization is the rapid deterioration in oxide polishing rates with successive wafers. The cause for the deterioration is known as "pad glazing", wherein the surface of a polishing pad becomes smooth such that slurry is no longer held in between the fibers of the pad. This physical phenomenon on the pad surface is not caused by any chemical reactions between the pad and the slurry.

To remedy the pad glazing effect, numerous techniques of pad conditioning or scrubbing have been proposed to regenerate and restore the pad surface and thereby restore the polishing rates of the pad. The pad conditioning techniques include the use of silicon carbide particles, diamond emery paper, blade or knife for scraping or scoring the polishing pad surface. The goal of the conditioning process is to remove polishing debris from the pad surface and re-open pores in the pad by forming micro-scratches in the surface of the pad for improved pad lifetime. The pad conditioning process can be carried out either during a polishing process, i.e. known as concurrent conditioning, or after a polishing process.

While the pad conditioning process improves the consistency and lifetime of a polishing pad, a conventional conditioning disk is frequently not effective in conditioning a pad surface after repeated usage. A conventional conditioning disk for use in pad conditioning is shown in FIGS. 2A, 2B and 2C.

Referring next to FIG. 2A, a conventional CMP apparatus 50 includes a conditioning head 52, a polishing pad 56, and a slurry delivery arm 54 positioned over the polishing pad. The conditioning head 52 includes a conditioning disk 68 which is mounted on a conditioning arm 58 which is extended over the top of the polishing pad 56 for making a sweeping motion across the entire surface of the polishing pad 56. The slurry delivery arm 54 is equipped with slurry dispensing nozzles 62 which are used for dispensing a slurry solution on the top surface 60 of the polishing pad 56. Surface grooves 64 are further provided in the top surface 60 to facilitate even distribution of the slurry solution and to help entrapping undesirable particles that are generated by coagulated slurry solution or any other foreign particles which have fallen on top of the polishing pad 56 during a polishing process. The surface grooves 64, while serving an important function of distributing the slurry, also presents a processing problem when the pad surface 60 gradually wears out after prolonged use.

The conventional conditioning disk 68 may be of several different types. A conventional brazed grid-type conditioning disk is formed by embedding or encapsulating diamond particles in random spacings with each other in the surface of a stainless steel substrate. A conventional diamond grid-type conditioning disk is formed by embedding cut diamonds at regular spacings in a nickel film coated onto the surface of a stainless steel substrate. The diamonds are typically coated with a diamong-like carbon (DLC) layer.

Referring next to FIGS. 2B and 2C, the CMP apparatus 50 typically further includes a polishing head 70 which is mounted on a rotatable shaft 72 above the top surface 60 of the polishing pad 56. The polishing head 70 holds and rotates a wafer (not shown) against the top surface 60 of the polishing pad 56 to polish the wafer. Before production wafers are polished using the CMP apparatus 50, time must be allotted to warm the polishing pad 56 and facilitate flow of polishing slurry from a slurry container (not shown) to the slurry delivery arm 54. This enhances polishing uniformity among successive wafers polished on the apparatus 50.

Conventional techniques for warming the polishing pad 56 preparatory to polishing of production wafers thereon include successive mounting of typically 3–4 dummy wafers 74 on the polishing head 70 and rotation of each dummy wafer 74 against the top surface 60 of the polishing pad 56, as shown in FIG. 2C. After use, the dummy wafers 74 may be recycled, and eventually, discarded. While this technique is useful in pre-conditioning the polishing pad 56, the cost of the dummy wafers 74 is inordinately high, and thus, best avoided. Accordingly, a new and improved apparatus and method is needed for the pre-conditioning of a polishing pad in a CMP apparatus.

It is an object of the present invention to provide a new and improved apparatus which is suitable for the pre-conditioning of a polishing pad on a CMP apparatus.

Another object of the present invention is to provide a new and improved apparatus which is suitable for rotary-type CMP apparatus.

Still another object of the present invention is to provide a new and improved CMP pad pre-conditioning apparatus which is economical in operation.

Yet another object of the present invention is to provide a new and improved CMP pad pre-conditioning apparatus which utilizes an ingot to pre-condition a polishing pad prior to the polishing of production semiconductor wafers.

A still further object of the present invention is to provide a new and improved method for pre-conditioning a CMP polishing pad.

Yet another object of the present invention is to provide a new and improved method for pre-conditioning a CMP polishing pad, which method is economical and may be used without dummy wafers.

Another object of the present invention is to provide a new and improved apparatus and method which saves time in the pre-conditioning of a polishing pad on a CMP apparatus.

Still another object of the present invention is to provide a new and improved apparatus and method which may be adapted to pre-condition a variety of substrates including but not limited to polishing pads.

SUMMARY OF THE INVENTION

In accordance with these and other objects and advantages, the present invention is generally directed to a new and improved apparatus and method suitable for the pre-conditioning of a polishing pad on a CMP apparatus prior to the polishing of production wafers on the apparatus. The apparatus includes a pre-conditioning arm on which is mounted an ingot of suitable material. In typical use, the ingot is pressed against the polishing surface of the rotating polishing pad for a selected period of time to increase the temperature of the polishing surface by friction. The pre-conditioned polishing pad facilitates uniform polishing rates of production wafers subsequently polished on the apparatus.

The pre-conditioning arm may be mounted in a base provided adjacent to the polishing pad for selective vertical adjustment of the ingot with respect to the polishing surface of the polishing pad. The pre-conditioning arm may further be pivotally mounted in the base to facilitate sweeping of the ingot over the polishing surface of the pad as the pad is rotated. The ingot may be a selected material including but not limited to copper, tantalum or silicon dioxide, and may have a round or alternative shape.

The present invention further contemplates a new and improved method for the pre-conditioning of a polishing pad in a CMP apparatus. The method includes providing an ingot of selected material, providing motion between the polishing pad and the ingot, and causing contact between the ingot and the polishing pad. The method may further include pressing the ingot against the polishing pad at a pressure of about 4~5 psi. The method may further include pressing the ingot against the rotating polishing pad for typically about 40~60 seconds. The method may still further include imparting a sweeping motion to the ingot over the polishing pad.

BRIEF DESCRIPTION OF THE DRAWINGS

The invention will now be described, by way of example, with reference to the accompanying drawings, in which.

DESCRIPTION OF THE PREFERRED EMBODIMENTS

The present invention is generally directed to an apparatus and method for pre-conditioning a polishing pad on a chemical mechanical polishing apparatus. However, the invention is not so limited in application and while references may be made to such chemical mechanical polishing apparatus, the invention is more generally applicable to the pre-conditioning of pads or substrates in a variety of industrial or mechanical applications.

Shown throughout the drawings, the present invention is generally directed to a new and improved apparatus for the pre-conditioning or warming of a polishing pad on a CMP apparatus to an operational temperature which facilitates subsequent uniform polishing of successive production wafer substrates on the apparatus. The apparatus includes a pre-conditioning arm on which is mounted an ingot of selected material. The pre-conditioning arm may be mounted in such a manner that it may be swept across the polishing surface of the polishing pad as the polishing pad is rotated in order to cover substantially the entire surface of the pad.

The ingot may be any material which is suitable for pre-conditioning of the polishing pad and typically depends on the type of CMP polishing operations to be subsequently carried out on the production wafers. For example, for a copper CMP operation, the ingot is preferably copper. Similarly, a silicon dioxide ingot is preferably used to pre-condition the polishing pad in an oxide CMP operation, whereas a tantalum ingot is preferably used to pre-condition the polishing pad in a tantalum CMP operation. The ingot may be provided in any desired shape or configuration, including but not limited to circular, thick plate, thin plate, block, column or rod configurations.

The present invention is further directed to a new and improved method for the pre-conditioning of a polishing pad on a CMP apparatus. The method includes providing an ingot of selected material, providing motion between the ingot and the polishing pad, and providing contact between the ingot and the polishing pad. Heat generated by friction between the ingot and the polishing pad is imparted to the pad. The heated or pre-conditioned polishing pad facilitates subsequent uniform polishing of production wafer substrates.

The method may further include pressing the ingot against the polishing pad at a pressure of typically about 4~5 psi. The ingot may be pressed against the polishing pad for typically about 40~60 seconds. The ingot may be swept across the polishing pad during the pre-conditioning operation to increase the surface area of contact between the ingot and the polishing pad. The method of the present invention further contemplates providing motion to the ingot while the polishing pad remains stationary or providing motion to both the polishing pad and the ingot during the pre-conditioning operation.

Figure 1A:
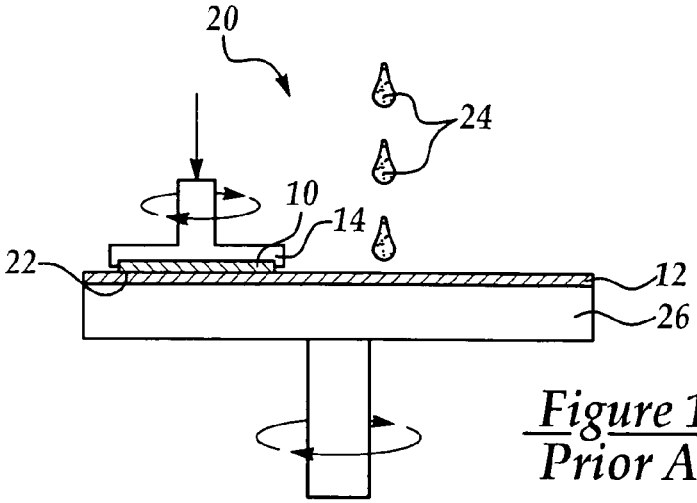
Figure 1A Prior Art
FIG. 1A is a cross-sectional view of a typical conventional chemical mechanical polishing (CMP) apparatus.
Figure 1B:
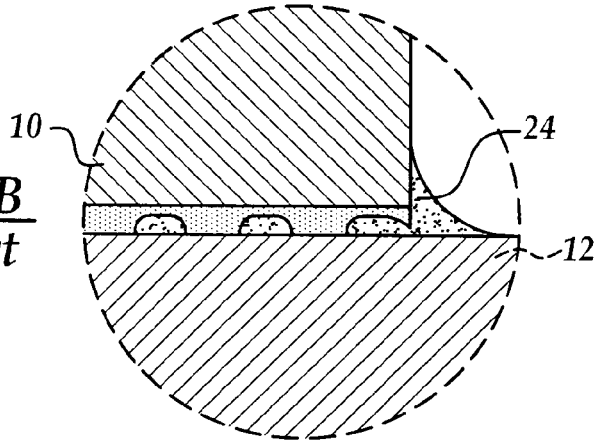
Figure 1B Prior Art
FIG. 1B is an enlarged, cross-sectional view of a section of a wafer and the polishing pad of a conventional CMP apparatus, with a slurry solution therebetween.
Figure 1C:
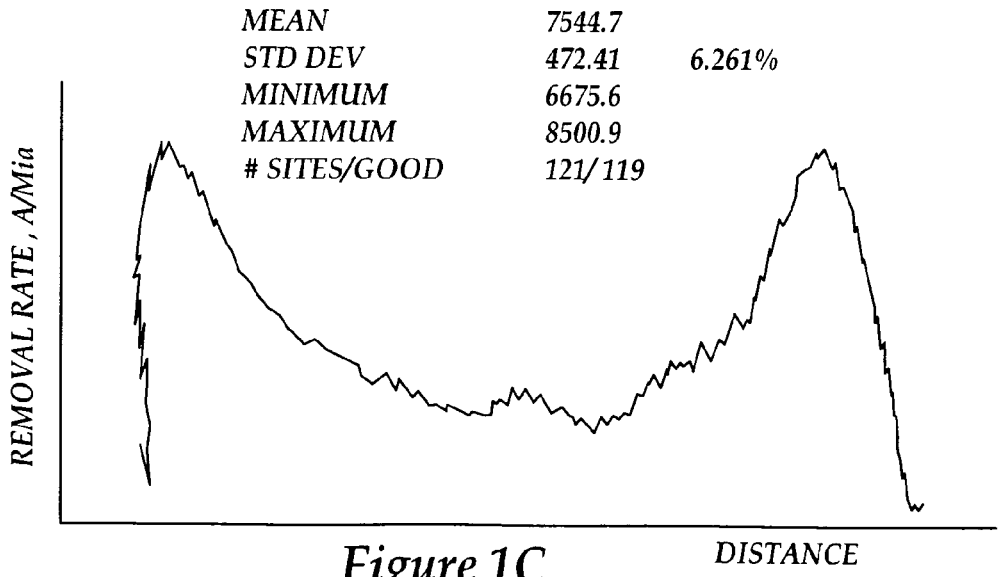
Figure 1C Prior Art
FIG. 1C is a graph illustrating the changes in removal rates as a function of distance on a wafer after a polishing pad is repeatedly used.
Figure 2A:
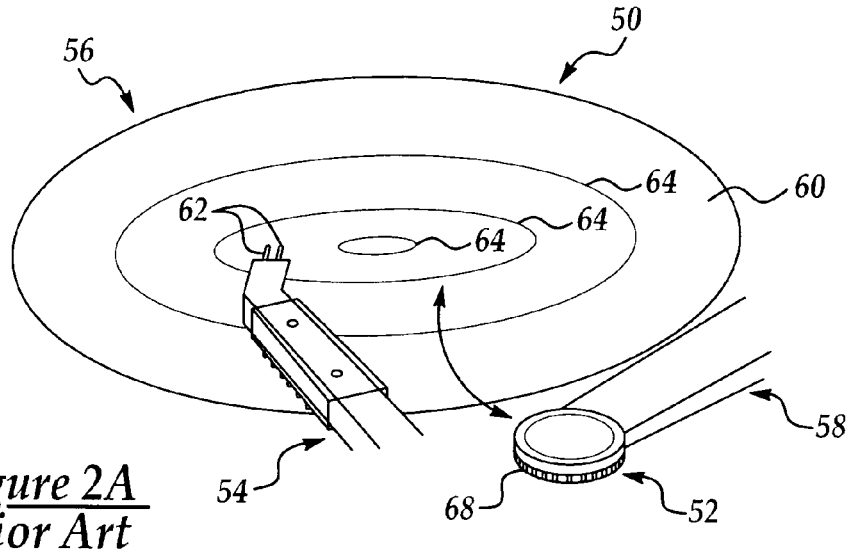
Figure 2A Prior Art
FIG. 2A is a perspective view of a conventional CMP apparatus having a polishing pad with a slurry dispensing arm and a conditioning disk positioned on top.
Figure 2B:
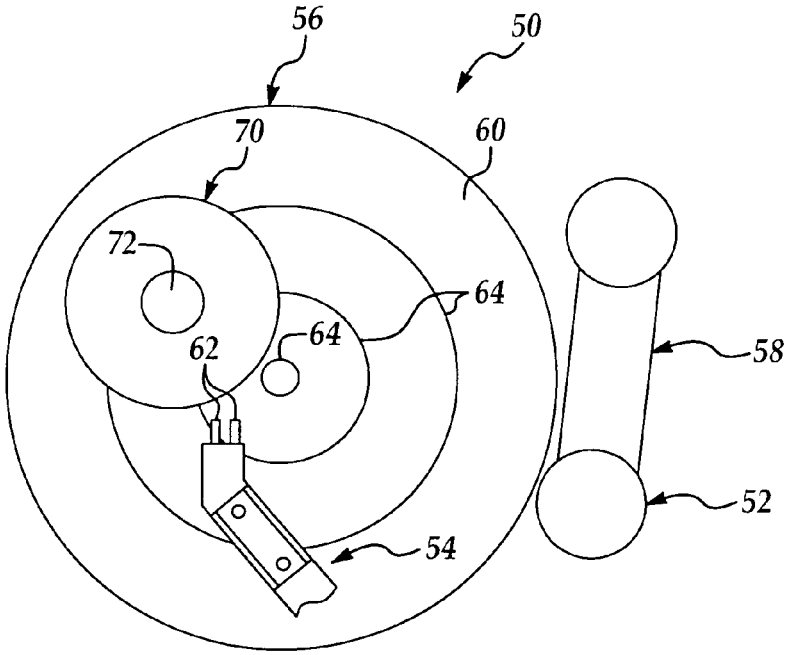
Figure 2B Prior Art
FIG. 2B is a top view of the conventional CMP apparatus of FIG. 2A.
Figure 2C:
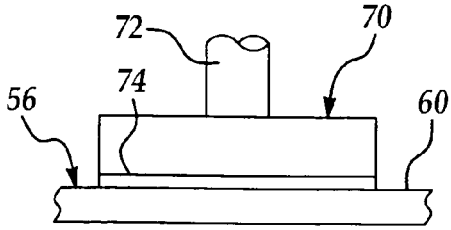
Figure 2C Prior Art
FIG. 2C is a cross-sectional view of a conventional polishing head with a dummy wafer interposed between the polishing head and a polishing pad.
Figure 3:
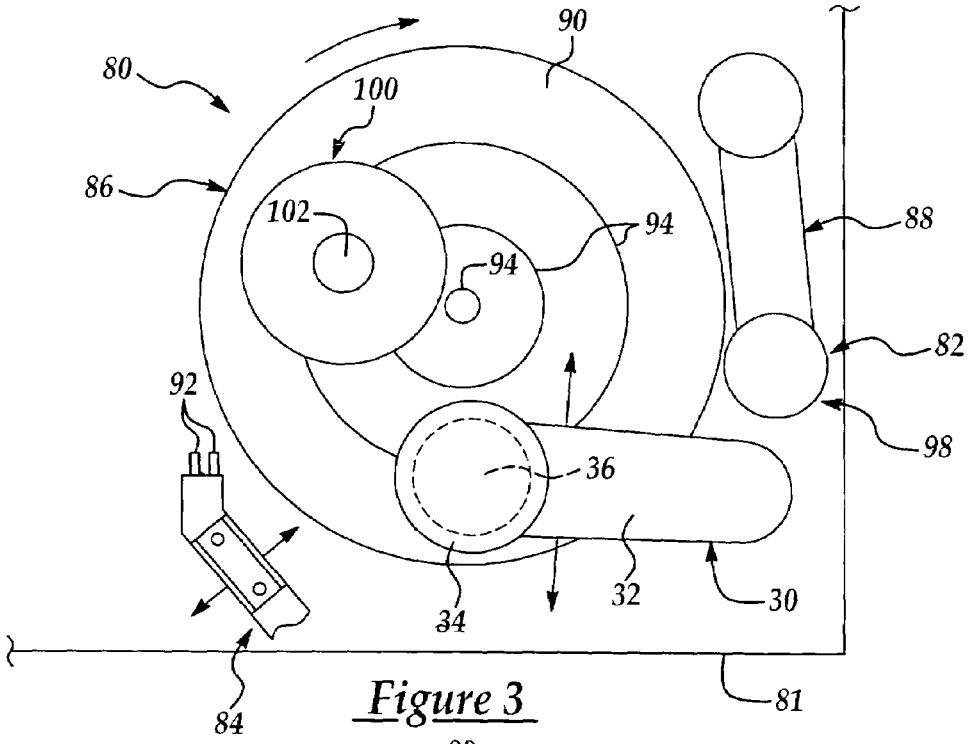
FIG. 3 is a top view of a CMP apparatus which includes a pre-conditioning arm in accordance with the present invention.
Figure 4:
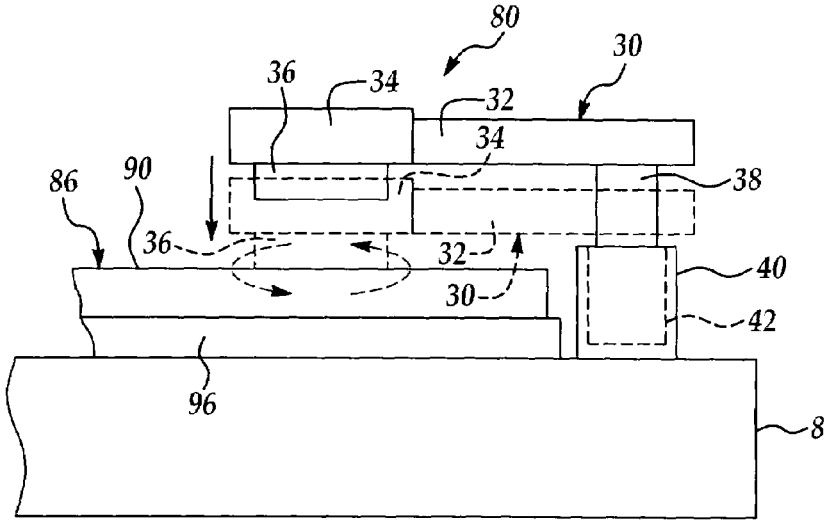
FIG. 4 is a side, partially schematic, view of the pre-conditioning arm of the CMP apparatus of FIG. 3, illustrating pre-conditioning of a polishing pad in implementation of the apparatus and method of the present invention.

Referring initially to FIGS. 3 and 4, an example of a CMP apparatus which includes a pre-conditioning arm of the present invention is generally indicated by reference numeral 80. It will be appreciated by those skilled in the art that the CMP apparatus 80 hereinafter described represents one example of a CMP apparatus which is suitable for the present invention and that the invention is equally suitable to CMP apparatus having characteristics which may depart partially or entirely from those hereinafter described. The CMP apparatus 80 may include a base 81 on which is mounted a rotatable platen 96, as shown in FIG. 4. A conditioning arm 88, having a conditioning head 82, is pivotally mounted on the base 81 and can be extended over and swept across the polishing surface 90 of a polishing pad 86 provided on the platen 96. A slurry delivery arm 84, also pivotally mounted on the base 81, may be swept from a home position, as shown, to a position over the polishing pad 86. As shown in FIG. 3, the conditioning head 82 includes a conditioning disk 98 which is mounted on the conditioning arm 88. The slurry delivery arm 84 is equipped with slurry dispensing nozzles 92 which are used for dispensing a slurry solution onto the polishing surface 90 of the polishing pad 86. Surface grooves 94 may be provided in the polishing surface 90 to facilitate an even distribution of the slurry solution thereon and to help entrapping undesirable particles that are generated by coagulated slurry solution or any other foreign particles which have fallen on top of the polishing pad 86 during a polishing process.

The CMP apparatus 80 typically further includes a polishing head 100 which is mounted on a rotatable shaft 102 above the polishing surface 90 of the polishing pad 86. In normal use of the CMP apparatus 80, the polishing head 100 holds and rotates a production wafer (not shown) against the polishing surface 90 of the rotating polishing pad 86 to polish the wafer, typically in conventional fashion.

A pre-conditioning arm 30 is pivotally mounted on the base 81, adjacent to the platen 96. The pre-conditioning arm 30 typically includes an elongated support 32, the proximal end of which is mounted on the upper end of a shaft 38. The shaft 38 may be telescopically received by an arm base 40 that is supported on the base 81. Preferably, the shaft 38 is partially rotatable with respect to the arm base 40. An actuation motor 42, which may be electric-actuated or fluid-actuated, may be provided in the arm base 40 and engages the lower end of the shaft 38. Accordingly, the pre-conditioning arm 30 may be selectively raised (as indicated by the solid lines in FIG. 4) and lowered (as indicated by the dashed lines in FIG. 4) by selective operation of the actuation motor 42. The actuation motor 42 may further include the facility for selectively partially rotating the shaft 38 with respect to the arm base 40 to facilitate sweeping the pre-conditioning arm 30 across the polishing surface 90, according to the knowledge of those skilled in the art.

An ingot mount head 34 is provided on the extending or distal end of the support 32 of the pre-conditioning head 30. An ingot 36 is typically removably mounted on the bottom surface of the ingot mount head 34, typically using screws (not shown) or other fastening techniques known by those skilled in the art. The ingot 36 may be copper, silicon dioxide or tantalum, in non-exclusive particular, depending on the type of CMP operation to be carried out on production wafers after pre-conditioning of the polishing pad 86, as hereinafter described. Furthermore, the ingot 36 may have a disk shape, as shown, or may be any suitable alternative shape or configuration. Preferably, the disk-shaped ingot 36 has a diameter of typically about 6~8 inches and a thickness of typically about 1~10 cm, and preferably, about 4~5 cm. As shown in FIG. 4, the ingot 36, normally disposed in a raised position with respect to the polishing surface 90 of the polishing pad 86, as indicated by the solid lines, may be selectively lowered and pressed against the polishing surface 90 by operation of the actuation motor 42, as indicated by the phantom lines and as hereinafter further described.

Figure 5:
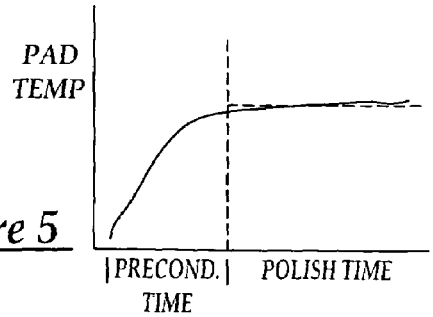
FIG. 5 is a graph of polishing pad temperature, plotted along the Y-axis, as a function of pad preconditioning time and substrate polishing time, plotted along the X-axis.

Referring next to FIGS. 3–5, in use of the pre-conditioning arm 30, before production wafers are polished using the CMP apparatus 80 time must be allotted to warm or pre-condition the polishing pad 86 and to facilitate flow of polishing slurry (not shown) from a slurry container (not shown) and through the slurry dispensing nozzles 92 of the slurry delivery arm 84. Accordingly, as the polishing pad 86 is rotated as shown in FIG. 3, the ingot 36 is lowered in place against the polishing surface 90, as indicated by the dashed lines in FIG. 4, by operation of the actuation motor 42. Preferably, the ingot 36 is pressed against the rotating polishing surface 90 at a pressure of typically about 4~5 psi for typically about 40~60 seconds. Simultaneously, polishing slurry (not shown) is distributed from the slurry tank (not shown) and onto the polishing surface 90 of the polishing pad 86 through the slurry dispensing nozzles 92 of the slurry delivery arm 84. As the polishing pad 86 rotates typically during transit of the polishing slurry to the slurry dispensing nozzles 92 (for typically about 40~60 seconds), friction is generated between the polishing surface 90 and the bottom surface of the ingot 36. The pre-conditioning arm 30 may be simultaneously swept across the polishing surface 90 in a side-to-side motion to increase the contact surface area between the ingot 36 and the polishing surface 90. This friction heats the polishing pad 86 to a stable operational temperature suitable for subsequent polishing of production wafers (not shown) using the polishing head 100, as shown in the graph of FIG. 5. When this stable operational temperature is reached, the actuation motor 42 is operated to lift the ingot 36 from the polishing surface 90, after which a production wafer (not shown) is mounted on the bottom surface of the polishing head 100 and rotated and polished against the polishing surface 90, typically in conventional fashion. It will be appreciated by those skilled in the art that the ingot 36 is capable of repeated usage without the need for replacement and significantly reduces the cost associated with using multiple successive dummy wafers to heat the polishing pad 86 to the operational temperature.

While the preferred embodiments of the invention have been described above, it will be recognized and understood that various modifications can be made in the invention and the appended claims are intended to cover all such modifications which may fall within the spirit and scope of the invention.

What is claimed is:

1. A polishing apparatus for condition and pre-conditioning a polishing pad to achieve a desired polishing pad temperature for a semiconductor wafer polishing operation, comprising:

a conditioning arm comprising a conditioning head, said conditioning arm pivotally mounted adjacent the polishing pad for conditioning the polishing pad;

a pre-conditioning arm mounted adjacent the polishing pad; and, an ingot consisting essentially of a first material, said ingot removeably and fixedly mounted on said pre-conditioning arm for engaging and pre-conditioning the polishing pad, said pre-conditioriing arm pivotable for sweeping said ingot across said polishing pad, said ingot for raising a temperature of said polishing pad to a desired operating temperature within a desired time period for polishing a semiconductor production wafer surface comprising said first material;

wherein an actuation mechanism operably engages said pre-conditioning arm for selectively moving said ingot into and out of contact with the polishing pad at a selected contact pressure.

2. The apparatus of claim 1, wherein the selected pressure is about 4 to about 5 psi.

3. The apparatus of claim 1, wherein said ingot has a thickness of about 1 to about 10 cm.

4. The apparatus of claim 1, wherein said ingot has a diameter of about 6 to about 8 inches.

5. The apparatus of claim 1 wherein said ingot consists essentially of a material selected from the group consisting of copper, silicon dioside and tantalum.

6. The apparatus of claim 1 wherein said pre-conditioning arm comprises a support and an ingot mount head carried by said support, and wherein said ingot is carried by said ingot mount head.

7. The apparatus of claim 6 wherein said ingot consists essentially of a material selected from the group consisting of copper, silicon dioxide and tantalum.

* * * * *